US008967789B2

(12) United States Patent
Mandel et al.

(10) Patent No.: US 8,967,789 B2
(45) Date of Patent: Mar. 3, 2015

(54) SPREADER/TRANSFIX SYSTEM FOR HANDLING TABBED MEDIA SHEETS DURING DUPLEX PRINTING IN AN INKJET PRINTER

(75) Inventors: Barry P. Mandel, Fairport, NY (US); Jeffrey J. Folkins, Fairport, NY (US); Alex S. Brougham, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 226 days.

(21) Appl. No.: 13/554,067

(22) Filed: Jul. 20, 2012

(65) Prior Publication Data

US 2014/0022323 A1 Jan. 23, 2014

(51) Int. Cl.
*B41J 2/01* (2006.01)
*B41J 11/00* (2006.01)

(52) U.S. Cl.
CPC ..... *B41J 11/0015* (2013.01)
USPC ..... 347/103

(58) Field of Classification Search
CPC ..... B41J 11/0015
USPC ..... 347/16, 21, 103; 271/3.01; 101/486
See application file for complete search history.

(56) References Cited

U.S. PATENT DOCUMENTS

| | | | | |
|---|---|---|---|---|
| 5,799,236 | A | 8/1998 | Paczkowski | |
| 5,835,831 | A | 11/1998 | Staudenmayer et al. | |
| 8,376,498 | B1 * | 2/2013 | Mandel et al. | 347/16 |
| 2006/0104687 | A1 | 5/2006 | Campbell et al. | |
| 2006/0170144 | A1 * | 8/2006 | Mandel et al. | 271/3.01 |
| 2009/0027436 | A1 | 1/2009 | McConville et al. | |
| 2009/0297234 | A1 | 12/2009 | Cahill | |
| 2011/0005419 | A1 * | 1/2011 | McConville et al. | 101/486 |
| 2011/0149001 | A1 | 6/2011 | Chappell et al. | |
| 2011/0221812 | A1 | 9/2011 | Ryan et al. | |
| 2013/0222466 | A1 * | 8/2013 | Kerxhalli et al. | 347/21 |

* cited by examiner

*Primary Examiner* — Julian Huffman
*Assistant Examiner* — Carlos A Martinez
(74) *Attorney, Agent, or Firm* — Maginot Moore & Beck LLP

(57) ABSTRACT

A method of operating a printer produces duplex images in print jobs including ink images to be printed to tabbed, hole-punched, and differently sized media sheets with improved throughput. The method synchronizes a media transport to insert a differently sized media sheet with reference to the type of media sheet, enabling the media sheet to contact a portion of the roller bearing substantially less release agent than the rest of the roller, minimizing release agent transfer to a second side of the media sheet.

20 Claims, 9 Drawing Sheets

SPREADER/TRANSFIX SYSTEM FOR HANDLING TABBED MEDIA SHEETS DURING DUPLEX PRINTING IN AN INKJET PRINTER

TECHNICAL FIELD

This disclosure relates to inkjet printers and, more particularly, to transferring ink images to media in these printers.

BACKGROUND

Drop on demand inkjet printing systems eject ink drops from printhead nozzles in response to pressure pulses generated within the printhead by either piezoelectric devices or thermal transducers, such as resistors. The ink drops are ejected toward an image receiving surface where each ink drop forms a pixel of an ink image on the image receiving surface. The printheads have a plurality of inkjet ejectors that are fluidly connected at one end to an ink supplying manifold through an ink channel and at another end to an aperture in a face plate of the printhead.

In some phase change or solid ink printers, known as direct printers, the printer ejects ink drops directly onto a print medium such as a paper sheet. After ink drops are printed on the print medium, the printer moves the print medium through a nip formed between two rollers that apply pressure and optionally heat to the ink drops and print medium. One roller, referred to as the "spreader roller" contacts the printed side of the print medium. The spreader roller is heated and coated with a release agent that prevents ink drops on the print medium from transferring onto the spreader roller. The second roller is referred to as a "pressure roller." This roller presses the media against the spreader roller. The pressure roller may be optionally heated to facilitate the fixing of the ink to the sheet of print medium. The heat and pressure applied through the nip flattens the ink drops and secures the printed ink image to the print medium in a process known as "fixing."

In an indirect printing embodiment, the printheads eject ink drops onto the surface of an intermediate image receiving member such as a rotating drum or endless belt. A "transfix" roller is positioned against the intermediate image receiving member to form a transfix nip. As a media sheet passes through the transfix nip in synchronization with the ink image on the intermediate image receiving member, the ink image transfers and fixes to the media sheet under pressure and heat in the transfix nip. The transfer and fixation of the ink image are well known to the art and are referred to as a transfix process.

Both direct and indirect inkjet printers are capable of producing either simplex or duplex prints. Simplex printing refers to production of an image on only one side of a print medium. Duplex printing produces an image on each side of a media sheet. In duplex direct printing, an ink image is formed on a first side of the media sheet, which then passes through the spreader nip to fix the ink image onto the first side of the media sheet. The medium is then inverted and sent along a path that passes the second side of the media sheet by the printheads for the formation of a second ink image on the second side. The sheet then returns to the spreader nip where the second ink image is fixed to the second side of the media sheet. A similar process is used with indirect printing, except the image is initially formed on an intermediate drum and then transferred to the media and fixed in the nip at the same time.

In both direct and indirect printing systems, having significant levels of oil on the media before imaging is undesirable, as the release agent can prevent ink from properly adhering or transferring to the media. Therefore, in a duplex printing process, preventing the release agent from transferring to the back side of a sheet during printing of the first side image is desirable. To achieve this goal, current printing systems slow down the transfix process and use special sheet and nip formation sequencing during duplex printing to prevent release agent from being transferred to the back of a sheet during front side printing. One technique for minimizing this problem is synchronizing the transfix or pressure rollers with the media sequencing so that the portion of the roller that contacts the back of the media sheet only contacted another media sheet on the previous revolution. The portion contacted was thus not in direct contact with the intermediate drum or the spreader roller, which would have transferred excess oil to the transfix or pressure roller surface and thus to the back of the present sheet. Unfortunately, synchronization of the rollers may not prevent release agent from transferring to media sheets having non-uniform edges, such as media sheets having extended tabs, pre-punched holes, or different sizes. Consequently, improved operation of direct and indirect printers that addresses the limited ability of current printers to keep release agent from tabbed, hole punched, and other non-uniform sized media sheets would be beneficial to higher throughput and image quality in such printers.

SUMMARY

In one embodiment, a method of operating a printer to avoid release agent being transferred to non-uniform structured or sized media has been developed. The method includes operating a media transport to move media sheets through a nip formed between a first roller and a second roller; applying release agent with an applicator to the first roller only; and adjusting operation of the media transport to insert a leading edge of a media sheet into the nip as a first portion of the second roller on which release agent transferred from the first roller exits the nip in response to the media sheet being different than a previous media sheet that passed through the nip to enable the media sheet to be interposed between the first roller and a second portion of the second roller bearing substantially less release agent than the first portion as the media sheet passes through the nip.

In another embodiment, a printer that avoids release agent being transferred to non-uniform structured or sized media has been developed. The printer includes a media transport, a release agent applicator, and a controller. The media transport includes a plurality of actuators, each actuator configured to drive a roller in the media transport to move media sheets through a nip formed between a first roller and a second roller. The release agent applicator is configured to apply release agent to the first roller only. The controller is operatively connected to the plurality of actuators of the media transport, and is configured to generate electrical signals to adjust operation of the media transport to insert a leading edge of a media sheet into the nip as a first portion of the second roller on which release agent transferred from the first roller exits the nip in response to the media sheet being different than a previous media sheet that passed through the nip to enable the media sheet to be interposed between the first roller and a second portion of the second roller bearing substantially less release agent than the first portion as the media sheet passes through the nip.

BRIEF DESCRIPTION OF THE DRAWINGS

The foregoing aspects and other features of a media path in a printer that controls the distribution of release agent between rollers that engage media sheets is explained in the following description taken in connection with the accompanying drawings.

DETAILED DESCRIPTION

Figure 1:
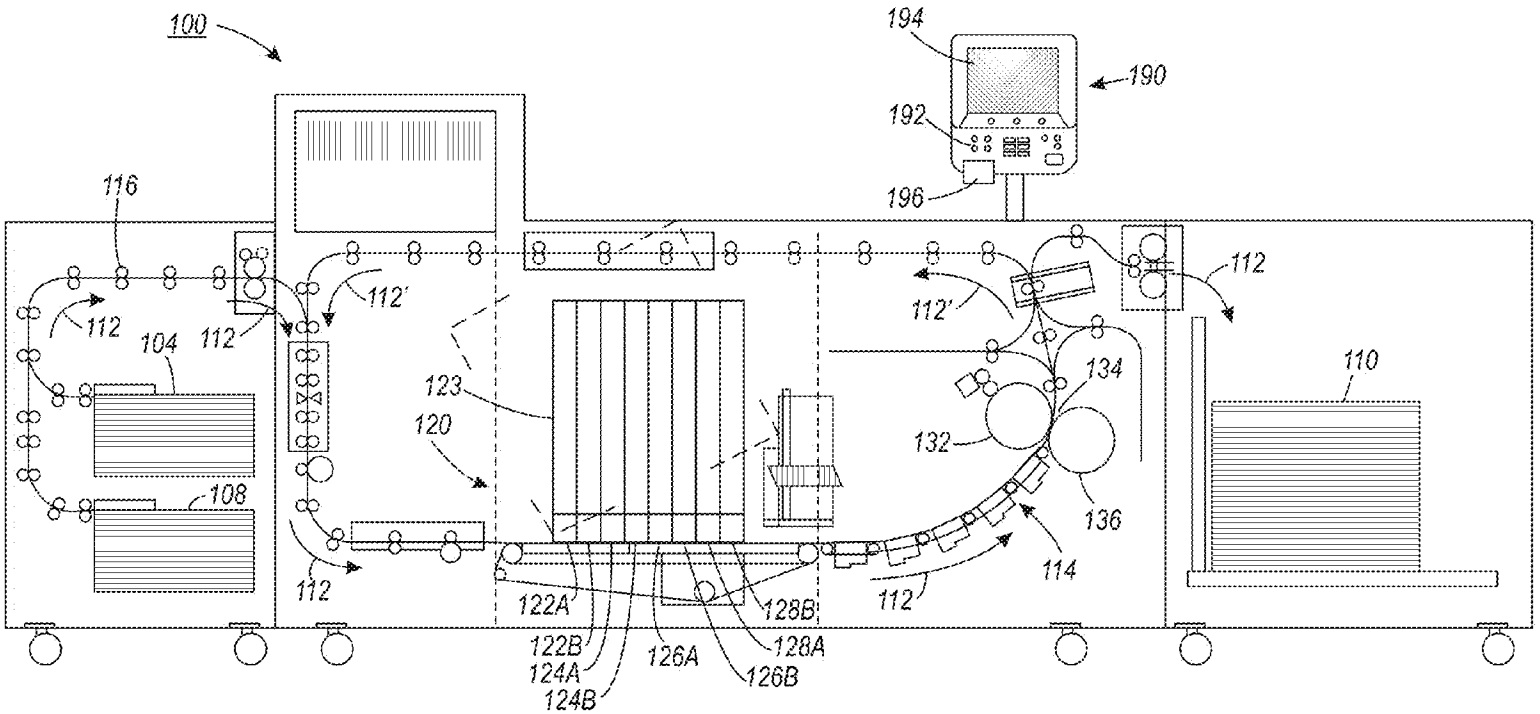
FIG. 1 is a schematic view of a direct printer.

For a general understanding of the environment for the system and method disclosed herein as well as the details for the system and method, reference is made to the drawings. In the drawings, like reference numerals have been used throughout to designate like elements. As used herein, the term "printer" encompasses any apparatus that produces images on media with one or more colorants for any purpose, such as a digital copier, bookmaking machine, facsimile machine, a multi-function machine, or the like. The systems and methods described below may be used with various printer embodiments. A direct printer ejects ink drops directly onto print media to form ink images on the media and subsequently fixes the ink image to the media sheet. An indirect printer forms an ink image on an intermediate image receiving member, such as a drum or endless belt, and transfers the ink image to a media sheet in a "transfix" operation that is well-known in the art. A single-pass indirect printer ejects images onto the intermediate image receiving member with no portion of the image passing by the ejectors more than once. A multi-pass indirect printer ejects portions of an image onto the image receiving member with each revolution, such that a complete image is ejected onto the image receiving member in two or more revolutions of the image receiving member.

A "media sheet" or "print medium" as used in this description may refer to any type and size of medium on which printers in the art produce images, including printer paper of various sizes. Each media sheet includes two sides, and each side may receive an ink image corresponding to one printed page. As used herein, the term "tabbed media sheet" refers to a media sheet containing a tab extending from one edge of the media sheet. The tabbed media sheet can be any size, including A4, letter, legal, or tabloid, and is generally the same size as other media sheets in a print job to enable the tab to extend from the completed print job to identify a section of the printed media.

As used herein, a "print job" or "document" is a set of related sheets, usually one or more collated copy sets copied from a set of original print job sheets or electronic document page images. A print job can contain data corresponding to a single size of media sheet, or multiple sizes of media sheets, some of which can be tabbed or hole-punched media sheets. An image generally includes information in electronic form, which is to be rendered into data used to generate signals that operate inkjet ejectors to form an ink image on an image receiving surface and can include text, graphics, pictures, and the like.

As used herein, the term "image receiving member" refers to any member having a surface that is configured to receive an ink image. In a direct printer, the image receiving member is typically print media, such as a paper sheet or continuous media web. In an indirect printer, the image receiving member is typically a rotating drum or endless belt that receives ink ejected by one or more printheads to form ink images. In a direct printer, a media transport carries print media along a media path past printheads in a print zone, while in an indirect printer the image receiving member rotates or moves past the printheads in a repeating manner. As used herein, the term "roller" refers to any cylinder or belt used in image fixation or transfer processes, for example, an image drum, image receiving belt, spreader roller, pressure roller, transfix roller, offset cylinder, impression cylinder, or fuser roller.

Phase change ink printers use phase change ink, also referred to as a solid ink, which is in a solid state at room temperature but melts into a liquid state at a higher temperature. The liquid ink drops are printed onto an image receiving member in either a direct or indirect printer. As described in more detail below, both direct and indirect printers apply a coating of release agent to selected components in the printer to prevent phase change ink from adhering to the printer components instead of the print medium. In one embodiment, the release agent is an oil such as silicone oil.

FIG. 1 depicts a direct inkjet printer 100 that controls a transfer of release agent between two rollers 132 and 136 while printing in a duplex mode. Printer 100 includes media supplies 104 and 108, a media path 112, a print zone 120, a media sheet conveyor 114, a spreader roller 132, a pressure roller 136, a media output tray 110, and a controller 190. The media supplies 104 and 108 are each configured to hold a plurality of media sheets and supply the media sheets to the printer via the media path 112 for printing. In the embodiment of printer 100, the media supplies 104 and 108 can hold media sheets of different sizes. For example, the media supply 104 holds letter size (215.9 mm×279.4 mm) media sheets, while the media supply 108 holds letter size tabbed media sheets. In alternative configurations, either or both media supplies 104 and 108 hold media sheets having A4 size (210 mm×297 mm), legal size (216 mm×356 mm), tabloid size (279 mm×432 mm), letter, legal, A4, or tabloid size tabbed media sheets, or various other sheet sizes. Other embodiments can include more than two media supplies to enable the printer to store and print a variety of media sizes and types. Various printer embodiments move the media sheets in either a length or width orientation during printing. Thus, the "length" of a media sheet in the process direction can be either of the length or width dimensions commonly used to describe a media sheet size. For example, the length of a letter size media sheet in the process direction can be either 215.9 mm or 279.4 mm depending on the orientation of the media sheet as a media transport moves the media sheet in a process direction through the printer. Furthermore, a tabbed media sheet can have the tab extending from an edge of the length or width of the media sheet, and therefore can be inserted into the nip as a leading edge, trailing edge, or on an edge on a side of the media sheet.

During a print job, media sheets from one or both of the media supplies 104 and 108 move along the media path 112. The media path 112 is a media transport that includes a plurality of guide rollers, such as guide rollers 116, which engage each media sheet and move the media sheets through the printer 100. In FIG. 1, the media path 112 guides each media sheet past a print zone 120 in a process direction for imaging operations on a first side of each media sheet. A portion of the media path 112' reverses an orientation of the media sheets and directs the media sheets through the print zone 120 a second time in the process direction to enable the print zone 120 to print ink images during imaging operations on the second side of each media sheet. As described in more detail below, a portion of the media path 112 between the print zone 120 and the rollers 132 and 136 includes a series of variable speed conveyors 114.

The print zone 120 includes a plurality of printheads arranged in a cross-process direction across a width of each media sheet. In FIG. 1, the print zone 120 includes a total of eight marking stations configured to print color images using a combination of cyan, magenta, yellow, and black (CMYK) inks. In the print zone 120, marking stations 122A and 122B print magenta ink, marking stations 124A and 124B print cyan ink, marking stations 126A and 126B print yellow ink, and marking stations 128A and 128B print black ink. Various alternative configurations print with a single color of ink, or include different ink colors including spot colors. Each of the marking stations 122A-128B includes a plurality of printheads, each one of which includes a plurality of inkjets.

The printheads in each set of marking stations 122A-122B, 124A-124B, 126A-126B and 128A-128B are arranged in interleaved and staggered arrays to enable printing over the entire cross-process width of a media sheet. For example, marking station 122A includes one array of staggered printheads that print images at a resolution of 300 drops per inch (DPI) in the cross-process direction over a media sheet. Each printhead in the staggered array covers a portion of the width of the media sheet, and the printheads are aligned end-to-end in the cross-process direction to print a continuous line of ink drops across the media sheet. Marking station 122B includes a second staggered array of printheads that are interleaved with the printheads in the marking station 122A to enable both of the marking stations to print magenta ink with a combined resolution of 600 DPI in the cross-process direction.

In the print zone 120, the printheads in each marking station eject liquid drops of a phase change ink. In one embodiment, the ink is supplied as a series of solid ink sticks to each of the marking stations 122A-128B. A heater positioned in each marking station melts the ink to supply liquefied ink to the corresponding printhead array. As depicted in FIG. 1, each marking station includes a set of supporting electronics 123. The electronics 123 include driver electronics, which generate the signals that operate the printheads in the marking station 122A. The printheads are also supplied with ink from a supply. In one alternative configuration, two marking stations that print a single color of ink receive melted solid ink from a single supply. In another alternative configuration, the phase change ink is supplied in a plurality of granular pastilles rather than in the form of ink sticks. While printer 100 is depicted as using a phase-change ink, the methods described herein can also be used in xerographic printers using oiled fuser systems, to offset printers using oiled offset systems, and to inkjet printers using alternative forms of ink including aqueous, gel, solvent based, and UV curable inks.

A media sheet moves through the print zone 120 to receive an ink image and the media path 112 moves the media sheet out of the print zone 120 in the process direction. The printheads in marking stations 122A-128B print ink drops onto a predetermined area of the surface of the media sheet as the media sheet moves through the print zone to form an ink image on the media sheet. A section of the media path 112 located after the print zone 120 includes one or more conveyors 114. The conveyors 114 are configured to control the velocity of the media sheet in the process direction as the media sheet approaches a nip 134 formed between spreader roller 132 and pressure roller 136 and to shift the media sheet in the cross-process direction. As described in more detail below, the printer 100 controls the rotation of the rollers 132 and 136 and the movement of media sheets on the conveyors 114 to enable each media sheet to pass through the nip 134 with minimal re-transfer of release agent to a non-imaged side of the media sheet during duplex print operations.

Figure 2:
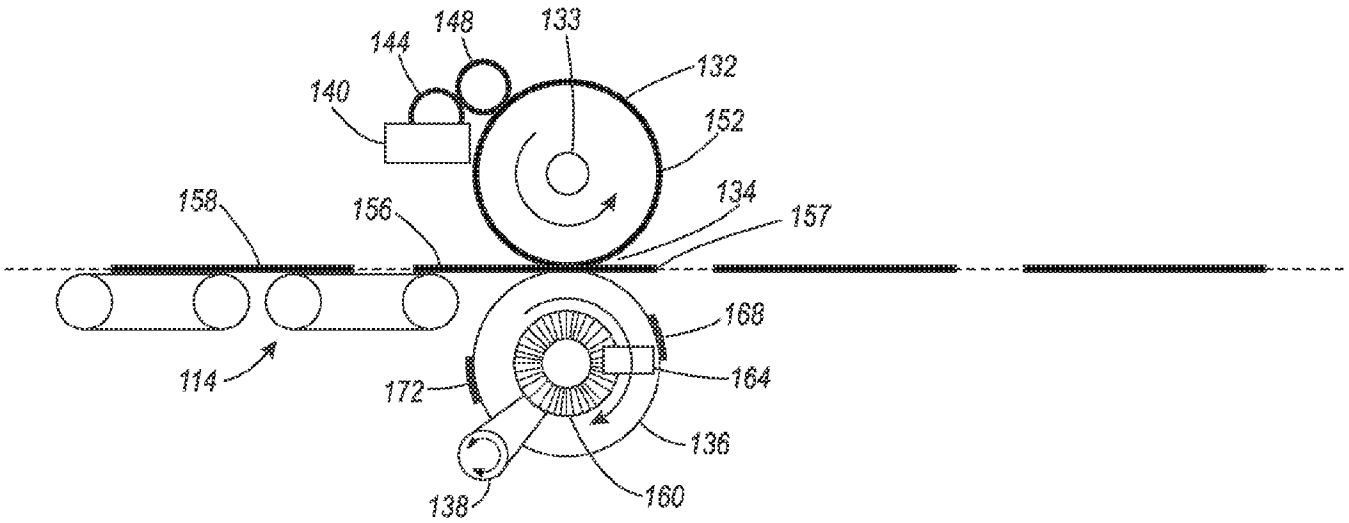
FIG. 2 is a schematic view of a spreader roller and a pressure roller of the direct printer depicted in FIG. 1.

FIG. 2 depicts the rollers 132 and 136 in the printer 100. Media sheets pass through the nip 134 formed between the rollers 132 and 136. In the embodiment of printer 100, both the spreader roller 132 and pressure roller 136 apply pressure to media sheets as the media sheets pass through the nip 134. The spreader roller 132 engages the side of the media sheet that carries the ink drops formed on the sheet in the print zone, and the pressure applied to the media sheet spreads and fixes the ink to the media sheet. An actuator 133 rotates the spreader roller 132 to move media sheets in the process direction, and the friction between the rollers generates a counter-rotation in the pressure roller 136. In other embodiments, a separate drive motor rotates the pressure roller 136 to position the pressure roller 136 accurately during periods when the nip is split or opened, for example, between print jobs. The side of each media sheet holding an ink image printed in the print zone 120 contacts the spreader roller 132, while pressure roller 136 contacts the opposite side of the media sheet. The rollers 132 and 136 apply pressure, and optionally heat, to the media sheet as the media sheet moves through the nip 134. The pressure and heat flatten individual ink drops formed on the media sheet so that the ink image formed on the media sheet is "fixed" to the sheet in a durable manner. A release agent 152 coats the surface of the spreader roller 132 that contacts the ink image on each media sheet. The release agent 152 is typically an oil, such as silicone oil, which prevents ink from adhering to the surface of the spreader roller 132. A drum maintenance unit 140 includes a reservoir holding the release agent. In the configuration of FIG. 2, two applicator rollers 144 and 148 apply the release agent 152 in a coating formed around the spreader roller 132, although alternative embodiments use different mechanisms to apply the release agent.

During operation, the rotational position of the pressure roller 136 can optionally be monitored by a rotational sensor including an optical encoder disk 160 and a sensor 164. The optical encoder disk is axially mounted to the pressure roller 136 and rotates with the pressure roller 136. As the optical encoder disk 160 rotates, the encoder 160 interrupts a light beam generated in the sensor 164, which generates signals corresponding to the interruptions in the light beam. The signals generated in the sensor 164 can identify both the rotational velocity of the pressure roller 136 and the rotational position of the pressure roller 136. In an alternative embodiment, the optical encoder disk includes a predetermined pattern of light and dark segments that alter the reflection of light from the surface of the optical disk to the sensor 164 as the optical encoder rotates. In still another embodiment, the pressure roller 136 is configured with a Hall Effect sensor. In an embodiment without a rotational sensor, the system uses the known diameter of the pressure roller and the timing used in the system to identify the rotational position of the roller and oil free areas of the roller.

During a print job where a series of media sheets pass through the nip 134, a portion of the release agent 152 formed on the spreader roller 132 transfers to the pressure roller 136 at areas of the rollers outside the width of the media sheet and when the rollers rotate in contact with each other in gaps that separate consecutive media sheets. In FIG. 2, release agent forms patches 168 and 172 on two portions of the surface of the pressure roller 136 as the pressure roller 136 contacts the spreader roller 132 between media sheets. The circumferential distance between the two patches corresponds to the length of the media sheets. As used herein, both of the terms "patch of release agent" and "portion of a surface roller having release agent" refer to an area on a roller that has a significantly greater amount of release agent than the other portions of the roller. As used herein, the term "portion on a surface of a roller bearing substantially less release agent" refers to a portion of a roller that has a lesser amount of release agent than the portion of the roller having release agent because the majority of the release agent in that portion has been transferred to a previous media sheet. A small amount of release agent may be present across the entire surface of the roller. In addition, while the patches 168 and 172 contain release agent across a longitudinal length of the pressure roller 136, the entire pressure roller 136 includes significant amounts of release agent on the outer sections of the pressure roller 136, outside the areas ordinarily contacted by media sheets 156.

In the configuration of FIG. 2, the pressure roller 136 has an outer circumference that is greater than twice the length of each media sheet 156 in the process direction, and the pressure roller 136 engages two different media sheets during each rotation in a "two-pitch" configuration. As used herein, the term "pitch" refers to a portion of a surface of a roller that engages a media sheet and a gap between one media sheet and a subsequent media sheet during a single rotation of the roller. The term pitch is often referenced in conjunction with a numerical designation. For example, in a single-pitch configuration, a roller engages one media sheet during a single rotation. The roller has a circumference that is longer than a length of the sheet in the process direction, so a section of the single-pitch does not engage the media sheet. As described below, the section of the pitch that does not engage the media sheet can contact another roller and accumulate a patch of release agent.

A roller with an integer, non-fractional, number of pitches engages the entire length of an integer number of media sheets during a single rotation. In a two-pitch embodiment, the pressure roller has a circumference that is larger than two times a length of a letter size media sheet in the direction of roller rotation. The two-pitch roller engages two media sheets during a single rotation with gaps on the roller separating the two media sheets. Rollers having different circumferences and media sheet sizes can accommodate three or more pitches as well. A single roller can operate as a single-pitch or multi-pitch roller for different sizes of media sheets and gaps between the media sheets in various print modes. In one print mode, the media transport in the printer 100 is operated in a two-pitch configuration to insert a leading edge of a next letter size media sheet into the nip as the identified portion of the surface of the pressure roller bearing substantially less release agent enters the nip.

The printer 100 controls the rotation of the rollers 132 and 136 and the speed of the media sheets 156 in the media path 112 to position a leading edge of each media sheet in the nip as one portion of the pressure roller 136 carrying the release agent exits the nip 134. For example, in FIG. 2, a leading edge 157 entered the nip 134 as the release agent patch 168 exited the nip. The media sheet 156 primarily contacts one portion of the pressure roller 136 that is between the release agent patches 168 and 172. In a duplex print mode, the spreader roller 132 fixes the first printed side of the media sheet 156, and the second side of the media sheet 156 exits the nip 134 receiving minimal release agent from the pressure roller 136. A subsequent media sheet 158 enters the nip 134 as the release agent patch 172 exits the nip 134. Consequently, the print zone 120 prints an ink image on the second side of the media sheets in a duplex mode with minimal dropout or reductions in image quality due to release agent contamination on the second side of each media sheet.

The printer controller is configured to operate the media transport to position a media sheet that is different than a previous media sheet at a position to enable the portions of the second side of the media sheet that are to receive ink drops in the second-side printing operation to receive minimal release agent transfer during the first-side imaging operation. The controller operates a plurality of actuators in the media transport to position the media sheet at the desired position longitudinally on the pressure or transfix roller. The actuators move the media sheet into the nip to enable the media sheet to enter the nip at a location that minimizes the potential for pixel dropout on the second side of the media sheet.

As discussed in detail below, the release agent transfer to a tabbed media sheet can be minimized by positioning the tab of the media sheet at an edge of the portion bearing substantially less release agent, enabling the second side of the tab and the majority of the media sheet to not receive release agent. For a media sheet having a size different from the previous media sheet printed, the controller can be configured to analyze the image data corresponding to the placement of the image on the second side of the media sheet. During the first-side printing operation the media sheet is positioned to enable most or all of the areas that receive ink in the second-side imaging operation to contact only the portion of the pressure or transfix roller bearing substantially less release agent. A similar media placement algorithm can be used for media sheets having holes punched or having irregular edges or shapes, and to place media sheets following the irregular sheet to minimize pixel dropout. Alternatively, the controller can be pre-programmed with instructions to place particular sizes and types of media sheets in predetermined positions corresponding to known printing patterns and typical image coverage, without reference to image data for the current media sheet. The controller can also be configured to receive user instructions corresponding to sheet placement and areas of the image to receive high priority as the controller determines the optimal image placement.

Figure 3A:
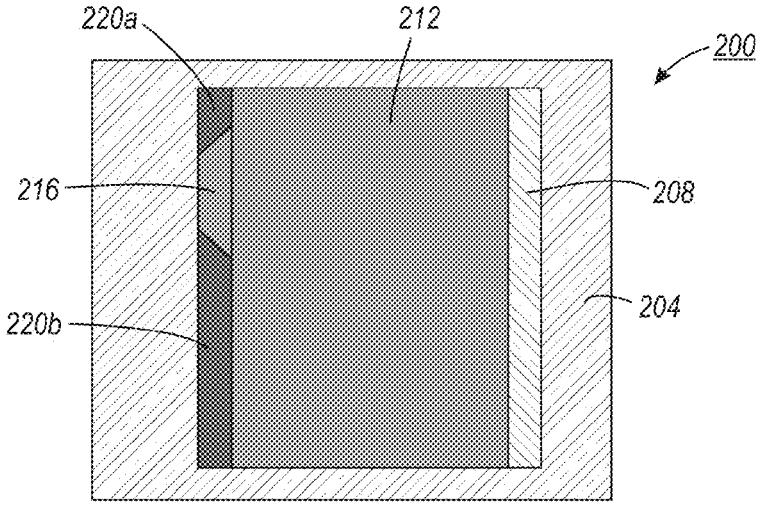
FIG. 3A is a view of a pitch of a pressure roller in a printer showing a position of a first tabbed media sheet on the pitch.
Figure 3B:
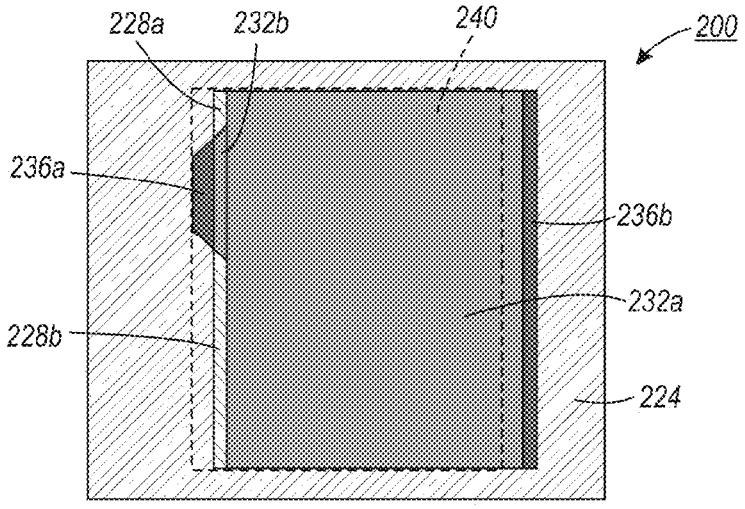
FIG. 3B is view of the pitch of FIG. 3A showing a position of a second media sheet positioned on the pitch.
Figure 3C:
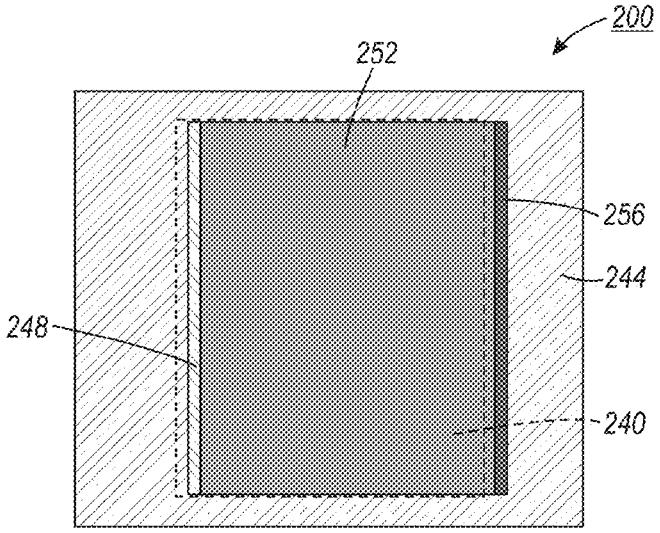
FIG. 3C is view of the pitch of FIG. 3A showing a position of a third media sheet positioned on the pitch.

FIG. 3A-3C illustrate one pitch 200 of a roller, such as the pressure roller 136 or transfix rollers 319 or 632, and the longitudinal and circumferential position of media sheets on the roller. The vertical direction in FIG. 3A-3C represents the circumferential length of the pitch on the roller, while the horizontal direction represents the axial length of the roller. In a multi-pitch roller two or more pitches, such as pitch 200, are positioned around the circumference of the roller, or stacked vertically in the representation of FIG. 3A-3C. The pitch 200 includes an area that was contacted by a previous media sheet in a nominal position 240 (FIG. 3B-3C), represented by areas 212, 216, 220*a*, and 220*b*, and an area containing release agent 204 and 208 that was transferred to the roller by contact with another roller containing release agent, such as spreader roller 132 or imaging drums 312 or 628. The areas contacted by the previous media sheet 212, 216, 220*a*, and 220*b* contain substantially less release agent than the other areas of the pitch, as the previous media sheet contacting the pitch 200 prevented the roller from receiving release agent and collected the majority of release agent on the roller in the areas 212, 216, 220*a*, and 220*b*.

When the controller receives an image to be printed on a tabbed media sheet having a tab on an edge on a side of the media sheet in a duplex print job, the controller generates signals to operate the actuators of the media transport to prevent the second side of the tab from receiving release agent. One or more actuators of the media transport shift the media sheet to align an edge of the tab with an edge of the area contacted by the previous media sheet 212, 216, 220*a*, and 220*b*. The leading edge of the media sheet is fed through the nip as the area contacted by the previous media sheet 212, 216, 220*a*, and 220*b* enters the nip. The second side of the tabbed media sheet therefore contacts areas 208, 212, and 216 on the pitch 200, as shown in FIG. 3A, enabling the tab to contact only the area on the roller that contacted the previous media sheet to prevent transfer of release agent to the second side of the tab. Release agent transfers only to area 208 on an edge of the tabbed media sheet opposite the extended tab. In general, tabbed media sheets are part of a print job that is bound or three-hole punched near the edge opposite the tab, and therefore ink is usually not ejected on the edge of the media opposite the tab. Thus, ink can be ejected onto the second side of the tab of the media sheet without pixel dropout, while the pixel dropout on the opposite edge of the media sheet is minimal.

FIG. 3B illustrates the placement of a second media sheet in the pitch 200 after the first tabbed media sheet contacts the pitch 200. The second media sheet is the same size as the first media sheet, but does not include a tab. The area contacted by the first tabbed media sheet 232*a*, 232*b*, 236*a*, and 236*b* is essentially clean of release agent, as the release agent in areas 232*a*, 232*b*, 236*a*, and 236*b* was transferred to the first media sheet. Thus, significant amounts of release agent are only present on the pitch in areas 224, 228*a*, and 228*b*. In order to move the alignment of media sheets back to the nominal position 240, the controller operates the media transport to position the second media sheet slightly toward the nominal position 240 from the area contacted by the edge of the first media sheet opposite the tab. Thus, the second sheet contacts areas 228*a*, 228*b*, 232*a*, and 232*b* on the roller, collecting release agent only from areas 228*a* and 228*b*. The size of areas 228*a* and 228*b* can be selected such that the areas of the media sheet that collect release agent are outside the printed region of the second side of the second media sheet. In one practical embodiment, the width of the areas 228*a* and 228*b* is approximately two millimeters, although different widths can be used in other embodiments depending on the characteristics of the print job and the width of the tab on the first media sheet.

FIG. 3C depicts the placement of a third media sheet on the pitch 200 of the roller. As the third media sheet is fed into the nip, the pitch 200 contains release agent on areas 244 and 248, while areas 252 and 256 that were contacted by the second media sheet are substantially clean of release agent. The media transport again aligns the media sheet slightly toward the nominal position 240 from the area clean of release agent 252 and 256, to enable the third media sheet to contact areas 248 and 252. The controller operates the media transport with reference to the nip to control the size of area 248 so release agent is transferred only to areas that are not be printed on the second side of the third media sheet. Alternatively, the controller can operate the media transport to keep the width of area 248 the same as the width of areas 228*a* and 228*b* and move the sheets uniformly toward the nominal position 240. The controller continues to instruct the media transport to shift subsequent media sheets toward the nominal position 240 until a media sheet is aligned with the nominal position, at which point the following media sheets are positioned at the nominal position on the pitch until another media sheet having a tab, hole punch, or different size is printed. In the illustrated embodiment, the media transport is operated to return the media sheets to the nominal position after approximately three media sheets. In other embodiments, the media transport can be operated to align the sheets to require more or fewer media sheets to return to the nominal position depending on the width of the tab and the characteristics of the print job. In one practical embodiment, printing on a tabbed media sheet with a twelve millimeter wide tab, the media sheets are returned to the nominal position after printing six sheets, each media sheet being shifted toward the nominal position approximately two millimeters from a previous media sheet.

Figure 4A:
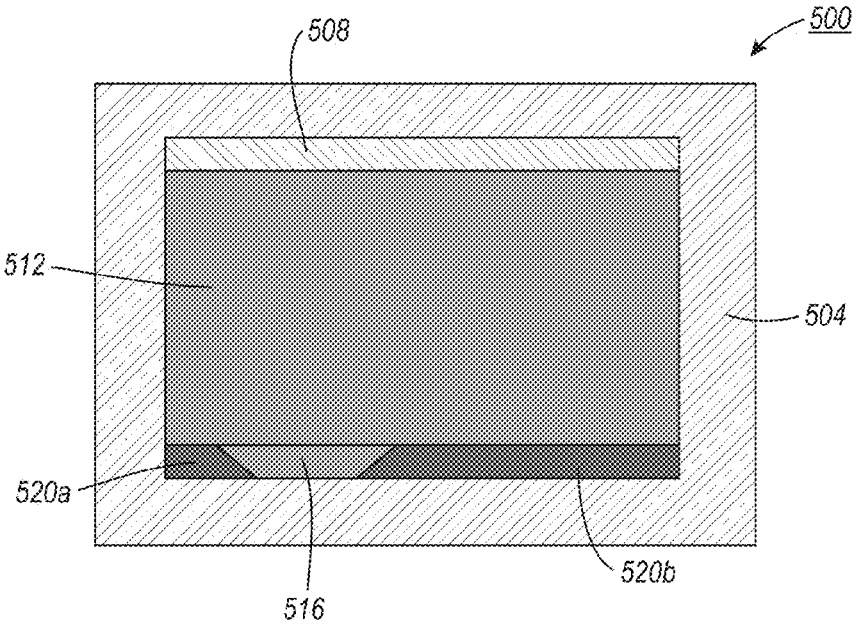
FIG. 4A is a view of a pitch of another pressure roller in a printer showing a position of a first tabbed media sheet on the pitch.
Figure 4B:
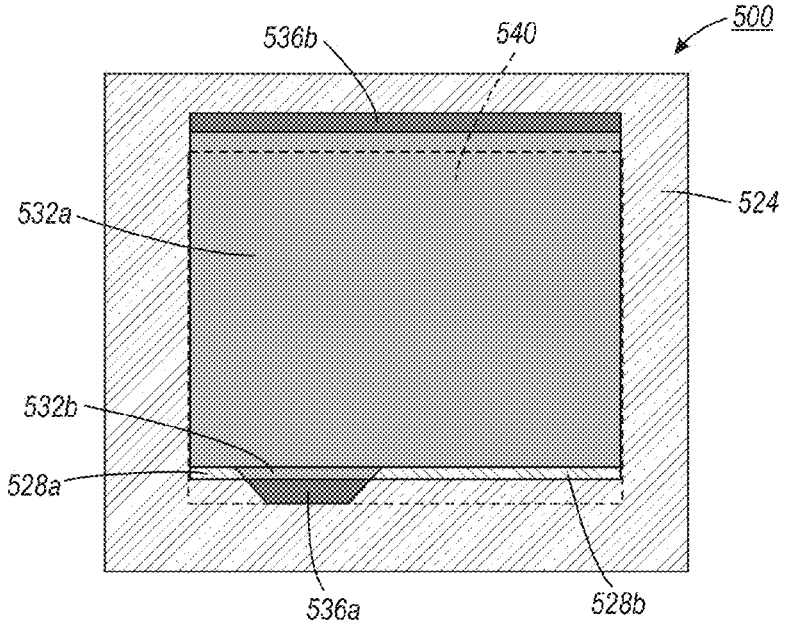
FIG. 4B is view of the pitch of FIG. 4A showing a position of a second media sheet positioned on the pitch.
Figure 4C:
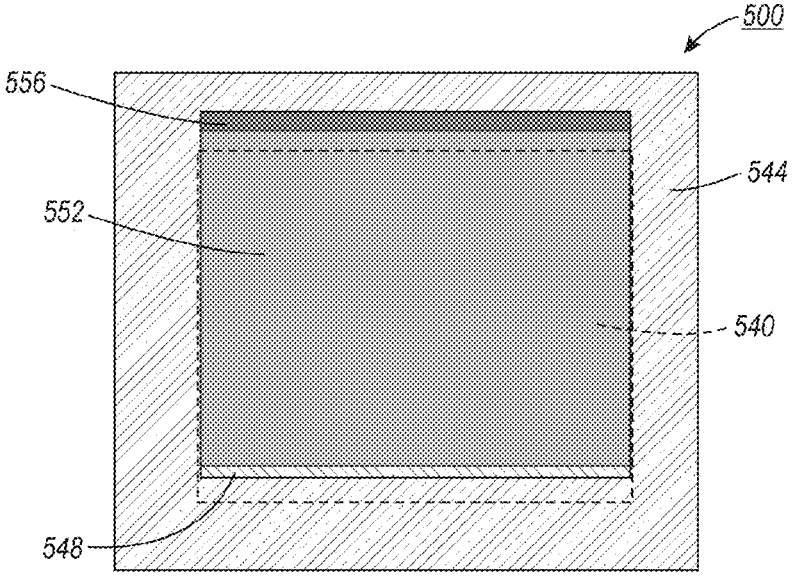
FIG. 4C is view of the pitch of FIG. 4A showing a position of a third media sheet positioned on the pitch.

FIG. 4A-4C illustrate a single pitch 500 for a roller configured to print on a tab that is on the leading edge of a media sheet. In FIG. 4A-4C, the vertical direction represents the circumference of the pitch in the process direction, with the leading edge of the paper contacting the pitch at the bottom portion of the figure, while the horizontal direction represents the longitudinal length of the roller. When the controller receives an image to be printed on a tabbed media sheet in a duplex print job with the tab on the leading edge of the media sheet, the printer operates the media transport to keep the second side of the tab from receiving release agent. The controller operates the media transport to alter the velocity of the media sheet as the media sheet approaches the nip to time the insertion of the leading edge of the tab with an edge of the area contacted by the previous media sheet 512, 516, 520*a*, and 520*b*, which is in a nominal position 540 (FIG. 4B-4C). The nominal position refers to the position media sheets are placed on the pitch in print jobs not containing tabbed media sheets, and can be centered across the longitudinal length of the roller and along the circumferential length of the pitch. The leading edge of the tab is fed through the nip as the area contacted by the previous media sheet 512, 516, 520*a*, and 520*b* enters the nip to enable the second side of the tabbed media sheet to contact areas 508, 512, and 516 on the pitch 500, as shown in FIG. 4A. The tab contacts only the area on the roller that contacted the previous media sheet, enabling the media sheet to pass through the nip with minimal transfer of release agent to the second side of the tab. Release agent transfers only to the media sheet from area 508 on an edge of the tabbed media sheet opposite the extended tab. In general, tabbed media sheets are part of a print job that is bound or three-hole punched near the edge opposite the tab, and therefore ink is usually not ejected on the edge of the media opposite the tab. Thus, ink can be ejected onto the second side of the tab of the media sheet without pixel dropout, while the pixel dropout on the opposite edge of the media sheet is minimal.

FIG. 4B illustrates the placement of a second media sheet in the pitch 500 after the first tabbed media sheet passes through the nip. The second media sheet is the same size as the first media sheet, but does not include a tab. The area contacted by the first tabbed media sheet 532*a*, 532*b*, 536*a*, and 536*b* is essentially clean of release agent, as the release agent in areas 532*a*, 532*b*, 536*a*, and 536*b* was transferred to the first media sheet. Thus, significant amounts of release agent are only present on the pitch in areas 524, 528*a*, and 528*b*. In order to move the alignment of media sheets back to the nominal position 540, the controller operates the actuators of the media transport to adjust the velocity of the second media sheet and time the entrance of the second media sheet into the nip slightly after the nominal position 540. Thus, the second sheet contacts areas 528*a*, 528*b*, 532*a*, and 532*b* on the roller, collecting release agent only from areas 528*a* and 528*b*. The size of areas 528*a* and 528*b* can be selected such that the areas of the media sheet that collect release agent are outside the printed region of the second side of the second media sheet. In one practical embodiment, the width of the areas 528*a* and 528*b* are approximately two millimeters, although different widths can be used in other embodiments depending on the characteristics of the print job and the width of the tab on the first media sheet.

FIG. 4C depicts the placement of a third media sheet on the pitch 500 of the roller. As the third media sheet is fed into the nip, the pitch 500 contains release agent on areas 544 and 548, while areas 552 and 556 are substantially cleaned of release agent. The controller adjusts operation of the media transport to regulate the velocity of the approaching third media sheet so the sheet enters the nip slightly after the nominal position 540, but slightly before the portion contacted by the second media sheet 552 and 556 to enable the third media sheet to contact areas 548 and 552. The operation of the media transport is controlled so area 548 has a size that transfers release agent only to areas that are not be printed on the second side of the third media sheet. Alternatively, the width of area 548 can be the same as the width of areas 528*a* and 528*b* to move the media sheets uniformly toward the nominal position 540. The controller continues to instruct the media transport to time subsequent media sheets to enter the nip closer to the nominal position 540 until a media sheet coincides with the nominal position 540, at which point the following media sheets are inserted into the nip as the nominal position enters the nip until another tabbed, hole-punched, or differently sized media sheet is printed. In the illustrated embodiment, the media sheets return to the nominal position after approximately three media sheets. In other embodiments, the media transport is operated by the controller to time the sheets to require more or fewer media sheets to return to the nominal position depending on the width of the tab and the characteristics of the print job. In one practical embodiment, printing on a tabbed media sheet with a twelve millimeter wide tab, the media sheets are returned to the nominal position after printing six sheets, each media sheet being positioned approximately two millimeters closer to the nominal position from the previous media sheet.

In another embodiment, where no ink is to be ejected on an area of the edge of the second side of the next media sheet having a width equal to the width of the tab, the next media sheet can be returned to the nominal position, with subsequent media sheets then printed at the nominal position without release agent transfer. In other embodiments, the distance of the offset of subsequent media sheets can be selected by the user. In still other embodiments, the controller determines the optimal placement of subsequent media sheets to reduce the number of media sheets needed to return to the nominal position without release agent transfer issues based on image content, ink locations, and media sheet types.

While FIG. 4A-4C were described above with reference to the tab on the media sheet being on the leading edge of the sheet, the media transport can be operated to position a media sheet including a tab on a trailing edge of the media sheet such that the tab does not collect release agent. Instead of operating the media transport to time the entrance of the leading edge of the media sheet into the nip as the clean area on the pitch enters the nip, the media transport times the entrance of the sheet to enter the nip before the clean area on the pitch enters the nip to enable the trailing edge of the tab to exit the nip as the trailing edge of the clean area exits the nip. Subsequent sheets are then inserted into the nip after the clean area enters the nip until the clean area returns to the nominal position.

In another embodiment, the media transport is configured not to return the media sheets to the previous nominal position. Instead, a new nominal position is established in the area contacted by the rectangular portion of the tabbed media sheet, for example, areas 508 and 512 of FIG. 4A. Subsequent media sheets are timed to enter the nip and positioned to contact the areas of the new nominal position. In a print job including successive tabbed media sheets, the tabs can be positioned to contact the area contacted by the previous tab. Alternatively, if the tab is not at the same position on the media sheet as the previous tab, then the tab can be aligned at the edge of the new nominal position to enable minimal transfer of release agent to the tab, and another new nominal position is established for the subsequent media sheet.

Figure 6:
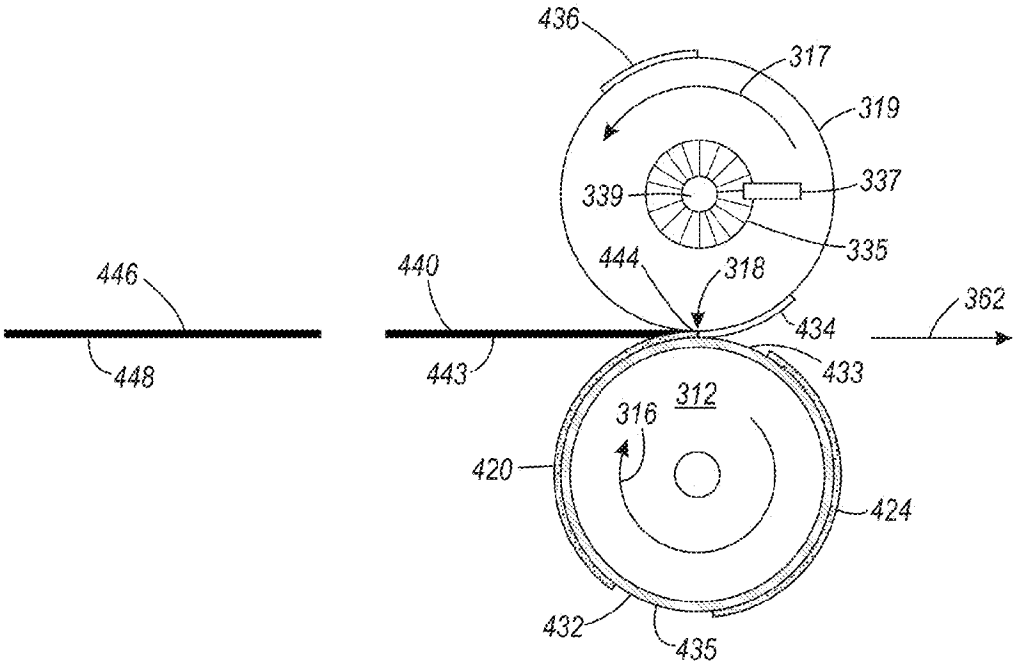
FIG. 6 is a schematic view of an imaging drum and a transfix roller in the printer depicted in FIG. 5.

In some multi-pitch configurations, the printer is operated by the controller to provide an alternating sequence of media sheets to the nip to further control the transfer of release agent to a roller, such as pressure roller 136 or transfix rollers 319 or 632, in a duplex print mode. Referring to FIG. 2 and FIG. 6, the media sheets pass through the nip in an interleaved order where one sheet passes through the nip during a first side imaging operation and the following media sheet passes through the nip during a second side imaging operation. The alternating sequence of first and second side media sheets continues during the print job. For example, in FIG. 2, a first side image formed on the media sheet 156 is fixed to the sheet as the sheet passes through the nip 134. The next media sheet 158 has previously undergone first side imaging, and a second side image is fixed to the second sheet 158 as the second media sheet 158 passes through the nip 134. In FIG. 6, the ink image 420 transfixes to the first side 443 of media sheet 440 as the media sheet 440 passes through the transfix nip 318, and the ink image 424 transfixes to a second side 448 of the next media sheet 446. Various configurations of the direct printer 100 and the indirect printer 300 sequence media sheets in an alternating first side and second side order. During the beginning of a print job, the printer operates in a reduced throughput print mode for a first number of media sheets until a sufficient number of media sheets with a first side image have been printed to enable the printer to provide the alternating sequence of first and second side media sheets to the nip.

The alternating media sheet sequence prevents a transfer of accumulated release agent from the pressure roller to an unprinted side of a media sheet during a duplex printing operation. During the second side printing, the previously printed first side of a media sheet contacts a pressure roller, for example, pressure roller 136 or transfix rollers 319 or 632. Release agent that transferred to the media sheet during the imaging of the first side transfers to the roller as the media sheet passes through the nip a second time. While the amount of the release agent transferred to the roller is typically less than the amount of release agent present in the release agent patches on the roller, the release agent can still transfer to a second side of a media sheet prior to printing the second side. The alternating sequence of the media sheets ensures that the section of the pressure roller that accumulates release agent from the first sides of duplexed media sheets only contacts the previously printed sides of duplexed media sheets, while a separate section of the pressure roller only contacts blank sides of media sheets that are free of release agent during first-side printing.

During a print job, the pressure roller 136 contacts the spreader roller 132 and remains in contact with roller 132 as multiple media sheets pass through the nip 134. An actuator 138 removes the pressure roller 136 from contact with the roller 132 between print jobs and during maintenance operations in the printer 100. A cleaning process removes release agent and other contaminants from the pressure roller 136 when the pressure roller 136 is removed from contact with the spreader roller 132. The actuator 138 moves the pressure roller 136 into engagement with roller 132 at the beginning of a print job. This engagement can be done quickly to minimize the transfer of release agent to the pressure roller 136.

In the printer 100, the controller and user interface 190 is operatively connected to various components and subsystems, including the media path 112, the print zone 120, the actuators 133 and 138, and the sensor 164 that senses the rotation of the pressure roller 136. The controller 190 receives and processes print job data that include image data and print job parameters. Exemplary print job parameters include the number of copies of the image data to be generated, the image and color quality levels of the printed images, and whether the printer should print the media pages in a simplex or duplex print mode. In some configurations the controller 190 receives the print job data through a network interface module 196, while in alternative configurations, such as a photocopier, an optical scanner generates image data corresponding to one or more pages. One or more print job parameters may be entered via user input controls 192, and a visual display 194 displays information about the status of a print job, ink and print media supply levels, and errors or other diagnostic information that pertain to the status of the printer 100.

The controller 190 can be implemented with general or specialized programmable processors that execute programmed instructions, for example, printhead operation. The instructions and data required to perform the programmed functions can be stored in memory associated with the processors or controllers. The processors, their memories, and interface circuitry configure the controllers to perform the processes that enable the printer 100 to control the transfer of release agent during duplex printing. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

During operation, the controller 190 generates electronic firing signals to operate individual inkjets in the printheads in each marking station 122A-128B as the media sheet moves through the print zone 120. The inkjets in the marking stations 122A-128B eject individual ink drops in response to each firing signal to form an ink image on each media sheet. To generate color images, the printer 100 ejects ink drops of different colors in close proximity to one another on the media sheet to form "dithered" patterns that the human eye perceives as a wide gamut of colors.

Figure 5:
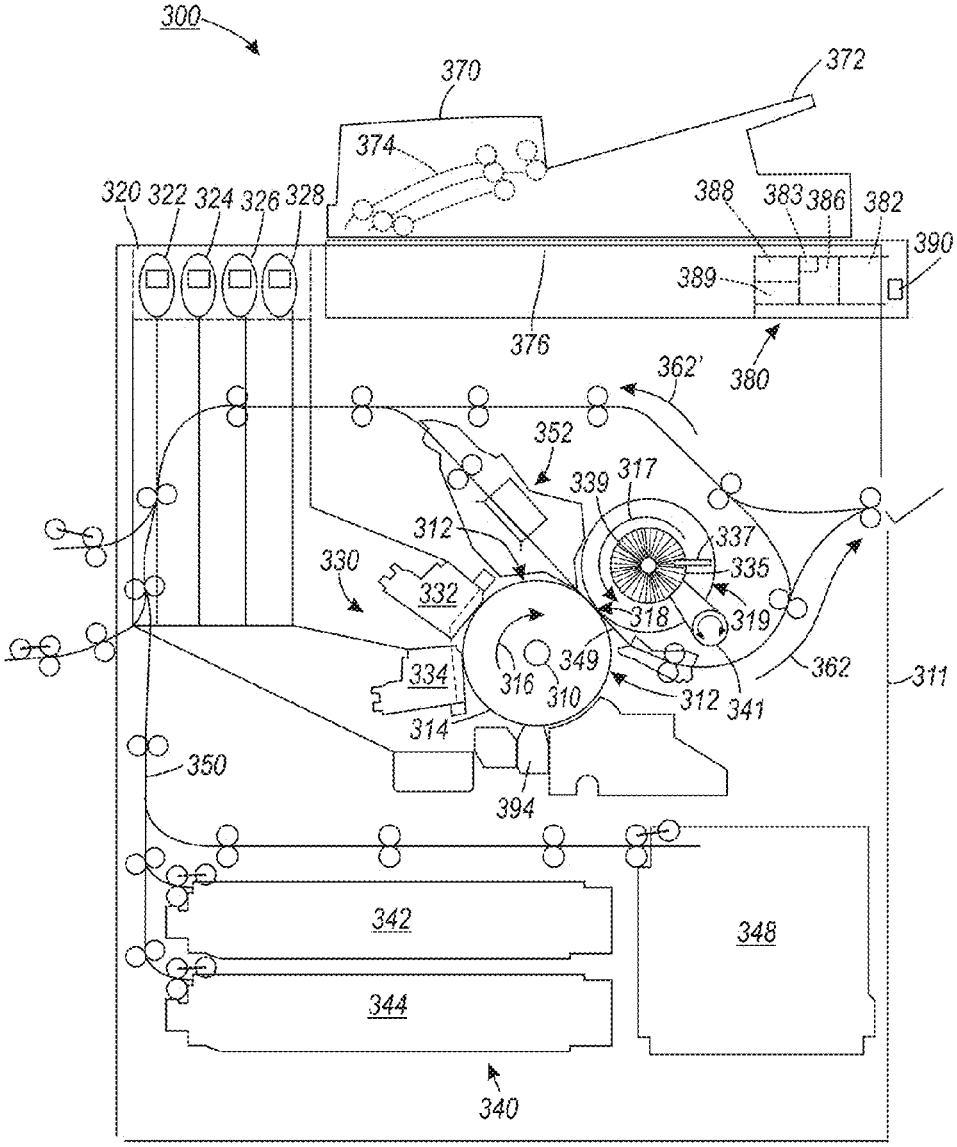
FIG. 5 is a schematic view of an indirect printer.

FIG. 5 depicts an embodiment of an indirect phase change inkjet printer 300 including a multi-color printhead assembly 332 and multi-color printhead assembly 334, rotating imaging drum 312, transfix roller 319, optical encoder disk 335 and controller 380. As illustrated, the printer 300 includes a frame 311 to which the operating subsystems and components described below are mounted directly or indirectly. The indirect phase change inkjet printer 300 includes an intermediate image receiving member 312 that is shown in the form of an imaging drum, but in other embodiments is in the form of a supported endless belt. The imaging drum 312 has an image receiving surface 314 that is movable in the direction 316, and on which phase change ink images are formed. A drum maintenance unit 394 includes a supply of release agent and applicators including rollers and metering blades that distribute a thin layer of release agent on the surface of the imaging drum 312. A transfix actuator 341 moves the transfix roller 319 into and out of engagement with the imaging drum 312. The transfix roller 319 rotates in the direction 317 when placed against the surface 314 of drum 312 to form a transfix nip 318 within which ink images formed on the surface 314 are transfixed onto a heated media sheet 349 that passes through the transfix nip 318.

During operation, the rotational position of the transfix roller 319 is monitored by a rotational sensor including an optical encoder disk 335 and a sensor 337. The optical encoder disk is mounted on an axle of the transfix roller 319 and rotates with the transfix roller 319. The optical encoder disk 335 and optical sensor 337 operate in the same manner as the optical encoder disk 160 and sensor 164 depicted in FIG. 2. The controller 380 identifies the rotational position and rotational velocity of the transfix roller 319 with reference to the signals generated by the optical sensor 337.

A media transport, depicted as media path 350, includes a plurality of rollers, some of which are driven by actuators operatively connected to a controller 380, and media guides that control the movement of media sheets such as media sheet 349 through the transfix nip 318 in a process direction 362 and a cross-process direction. The media path 350 further includes a duplex process direction 362'. In a duplex print mode, the printer 300 transfixes an ink image to a first side of a media sheet, and the media sheet moves through the media path 350 in the duplex process direction 362' to invert the media sheet. The inverted media sheet passes through the transfix nip 318 a second time and the printer 300 transfixes a second ink image to the second side of the media sheet.

Operation and control of the various subsystems, components and functions of the printer 300, including the media path 350 and printhead assemblies 332 and 334, are performed with the aid of a controller or electronic subsystem (ESS) 380. The ESS or controller 380, for example, is a self-contained, dedicated computer having a central processor unit (CPU) 382 with a memory 383, and a display or user interface (UI) 386. The ESS or controller 380, for example, includes a sensor input and control circuit 388 as well as an ink drop placement and control circuit 389. In addition, the CPU 382 reads, captures, prepares and manages the image data flow associated with print jobs received from image input sources, such as the scanning system 376, or an online or work station connection 390, and controls the printhead assemblies 332 and 334. As such, the ESS or controller 380 is the main multi-tasking processor for operating and controlling all of the other printer subsystems and functions.

The controller 380 can be implemented with general or specialized programmable processors that execute programmed instructions, for example, printhead operation. The instructions and data required to perform the programmed functions can be stored in the memory 383 associated with the processors or controllers. The memory 383 includes one or more digital data storage devices including, but not limited to, static and dynamic random access memory (RAM), magnetic and optical disk storage devices, read-only memory (ROM), and solid state data storage devices including NAND flash data storage devices. The processors, their memories, and interface circuitry configure the controllers to perform the processes, described more fully below, that enable operation of the imaging drum 312, transfix roller 319, optical sensor 337, and media path 350 to perform duplex printing while controlling the transfer of release agent to media sheets. These components can be provided on a printed circuit card or provided as a circuit in an application specific integrated circuit (ASIC). The CPU 382 can be implemented as a special-purpose VLSI circuit, or can be a general purpose microcontroller or processor, for example, processors in the x86 and ARM families. Each of the circuits can be implemented with a separate processor or multiple circuits can be implemented on the same processor. Alternatively, the circuits can be implemented with discrete components or circuits provided in VLSI circuits. The circuits described herein can also be implemented with a combination of processors, ASICs, discrete components, or VLSI circuits.

The phase change ink printer 300 also includes a phase change ink delivery subsystem 320 that has multiple sources of different color phase change inks in solid form. Since the phase change ink printer 300 is a multicolor printer, the ink delivery subsystem 320 includes four (4) sources 322, 324, 326, 328, representing four (4) different colors CMYK (cyan, magenta, yellow, and black) of phase change inks. The phase change ink delivery subsystem also includes a melting and control apparatus (not shown) for melting phase change ink from a solid state to a liquid state. Each of the ink sources 322, 324, 326, and 328 includes a reservoir used to supply the melted ink to the printhead system 330. In the example of FIG. 3, ink sources 322, 324, 326, and 328 supply cyan, magenta, yellow, and black inks, respectively, to the multicolor printhead assemblies 332 and 334. In some configurations, the imaging drum 312 completes two or more rotations as the printhead assemblies 332 and 334 form ink images on the imaging drum 312 in a multi-pass printing configuration.

The phase change ink printer 300 includes a substrate supply and handling subsystem 340. The substrate supply and handling subsystem 340, for example, may include sheet or substrate supply sources 342, 344, and 348, of which supply source 348, for example, is a high capacity paper supply or feeder for storing and supplying image receiving substrates in the form of cut sheets 349. In one configuration, the supply sources 342-348 store media sheets of different sizes such as letter, A4, legal, and tabloid media sizes, some of which can include tabs or punched holes. The printer 300 executes print jobs that specify the various media sheet sizes and types and the media supply path 350 extracts media sheets from one of the media sources 342-348 according to the media size and type specified in each print job. The substrate supply and handling subsystem 340 also includes the substrate media path 350 that has a substrate heater or pre-heater assembly 352. The phase change ink printer 300 as shown can include an original document feeder 370 that has a document holding tray 372, document sheet feeding and retrieval devices 374, and a document exposure and scanning subsystem 376.

In operation, the printer 300 receives a print job containing image data for one or more images from either the scanning subsystem 376 or via the online or work station connection 390. Additionally, the controller determines and/or accepts related subsystem and component controls, for example, from operator inputs via the user interface 386, and accordingly executes such controls. During a warm up operation at the beginning of the print job, the controller 380 can activate one or more heaters in the ink delivery subsystem 320 and the printhead assemblies 332 and 334 to provide molten ink to each of the printheads and inkjets in the printer 300. The printer 300 performs a warm up operation subsequent to leaving a deactivated state or a low power sleep mode prior to commencement of the print job.

Printhead assemblies 332 and 334, when activated by firing signals generated by the controller, eject ink drops onto selected locations of the imaging surface 314 to form ink images corresponding to the image data. Media sources 342, 344, and 348 provide image receiving substrates that pass through substrate media path 350 to arrive at transfix nip 318 formed between the image receiving member 312 and transfix roller 319 in timed registration with the ink image formed on the image receiving surface 314. As the ink image and media travel through the nip 318, the ink image is transferred from the surface 314 and fixedly fused to the image substrate within the transfix nip 318. During the imaging and transfixing operations, the controller 380 identifies the rotational position of the transfix roller 319 with reference to signals generated by the optical sensor 337 in response to rotation of the optical encoder disk 335. The controller 380 identifies one or more sections of the transfix roller 319 that do not carry release agent using the optical sensor 337 and information stored in memory corresponding to placement of previously printed media sheets. The controller 380 also operates the actuators of the media path to regulate the position of the media sheets as described above with reference to FIG. 3A-FIG. 4C as the media sheets are supplied to the transfix nip 318.

FIG. 6 depicts the imaging drum 312 and transfix roller 319 of FIG. 5 in a two-pitch configuration where the printer 300 transfixes ink images to two media sheets during a single rotation of the transfix roller 319. In the example embodiment of FIG. 6, the printer 300 forms two latent ink images 420 and 424 on a thin layer of release agent 432 that covers the surface of the imaging drum 312. The transfix roller 319 engages the imaging drum 312 to form a transfix nip 318 with the transfix roller engaging the imaging drum 312 in an inter-document gap 433 formed between the ink images 420 and 424. As used herein, the term "inter-document gap" refers to a portion of the surface of an image receiving member that is positioned between ink images corresponding to two different pages in a print job, or to a portion of the surface of the image receiving member that is positioned between two ends of a single ink image when a single ink image is formed on the image receiving member.

The imaging drum 312 rotates in direction 316 and the transfix roller 319 rotates in direction 317 as a first media sheet 440 approaches the transfix nip 318. A patch of release agent 434 transfers from the imaging drum 312 to the transfix roller 319 as the transfix roller 319 rotates through the inter-document gap 433. The leading edge 444 of a first media sheet 440 enters the transfix nip 318 according to the timing sequence discussed above with reference to FIG. 3A-4C. The imaging drum 312 and transfix nip 319 rotate to transfix the ink image 420 to a first side 443 of the media sheet 440.

In a single-pass printing configuration, the transfix roller 319 remains in contact with the imaging drum 312 through a second inter-document gap 435 that contacts the transfix roller 319 at the location of a second release agent patch 436 formed on the transfix roller 319. A second media sheet 446 enters the transfix nip 318 as the second release agent patch 436 exits the transfix nip 318, and the imaging drum 312 and transfix roller 319 transfix the second ink image 424 to the first side 448 of the media sheet 446.

In a multi-pass configuration, the transfix roller 319 remains in contact with the imaging drum 312 through a portion of second inter-document gap 435 and the transfix actuator 341 subsequently disengages the transfix roller 319 from the imaging drum 312. The printhead assemblies 332 and 334 form ink images on one or more defined areas of the imaging receiving surface 314 as the imaging drum 312 completes two or more rotations. The transfix actuator 341 re-engages the transfix roller 319 with the imaging drum 312 in a position within one of the inter-document gaps on the imaging drum 312 after the images are formed on each area of the image receiving surface 314 of the imaging drum 312. Some multi-pass printer configurations include a transfix roller actuator that is operated by a controller that is configured to rotate the transfix roller 319 to engage a patch of release agent on the transfix roller 319 with the imaging drum 312 after ink images are formed on the imaging drum 312.

In the embodiment of FIG. 6, the imaging drum 312 has approximately the same circumference as the transfix roller 319. Alternative embodiments, however, include imaging drums with a wide range of sizes. The imaging drum can be the same size as the transfix roll or the drum can be sized such that an integer number of images can be formed around the circumference of the imaging drum. FIG. 6 is referred to as a two-pitch configuration where two areas with minimal release agent are formed on the transfix roller 319. Alternative transfix roller and media sheet sizes can operate with one, three, or more pitches around the transfix roller. The controller 380 identifies the rotational position of the transfix roller 319 with the optical sensor 337 and identifies the portions of the transfix roller 319 that carry the release agent patches 434 and 436 and the portions of the transfix roller 319 that do not carry release agent. The portions of the transfix roller 319 that do not contain release agent are determined by the controller from a combination of the information obtained from the optical sensor 337 and information stored in the controller memory corresponding to the placement of the previous media sheet that contacted a particular pitch. The controller 380 adjusts the rotation of the imaging drum 312 and the timing of the media path 350 as described above with reference to FIG. 3A-4C to enable tabbed and untabbed media sheets to be positioned on the transfix roller 319 where minimal release agent is transferred to the media sheet. Consequently, the second side of each of the media sheets 440 and 446 is substantially free of release agent prior to a duplex imaging operation. In the printer 300, the transfix actuator 341 removes the transfix roller 319 from engagement with the imaging drum 312. A transfix roller actuator 339 rotates the transfix roller 319 to a rotational position that enables a release agent patch formed on the transfix roller 319 to contact an inter-document gap on the imaging drum 312 at the beginning of another transfix operation.

Figure 7:
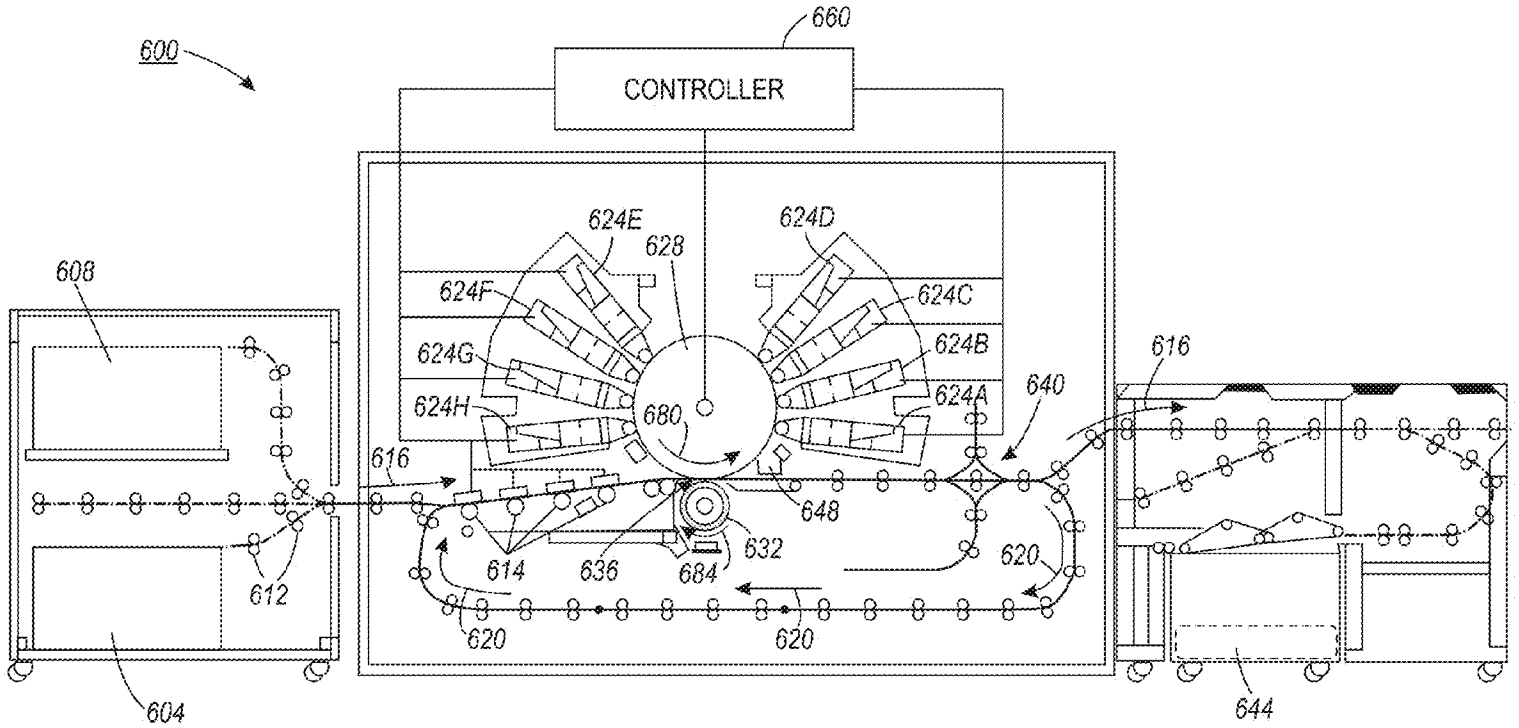
FIG. 7 is a schematic view of a single-pass indirect printer.

FIG. 7 illustrates a single-pass indirect printer 600 including printheads 624A-624H, a rotating imaging drum 628, a transfix roller 632, media supplies 604 and 608, a media output tray 644, and a controller 660. The imaging drum 628 rotates in direction 680, and has an image receiving surface on which ink images are formed. A drum maintenance unit 648 includes a supply of release agent and applicators including rollers and metering blades that distribute a thin layer of release agent on the surface of the imaging drum 628. The transfix roller 632 is fixed in place and configured to contact the imaging drum 628 and rotate in direction 684 as the imaging drum 628 rotates in direction 680, forming a transfix nip 636 within which ink images formed on the drum surface are transfixed onto a media sheet that passes through the transfix nip 636. During operation, the rotational position of the transfix roller 632 is monitored by the controller 660, which identifies the position of the transfix roller 632 from the known diameters of the roller 632 and drum 628 and the rotation of the imaging drum 628.

In the single-pass printer 600, printheads 624A-624H eject one or more complete ink images onto the imaging drum 628 with each rotation of the imaging drum 628. Each complete ink image is then transferred to a media sheet in the nip 636 as the drum rotates. The drum receives a complete image with every rotation, enabling the transfix roller 632 to remain in a fixed position engaged with the image drum 628. The transfix roller 632 in the embodiment of FIG. 7 is smaller than the imaging drum 628, although in other embodiments, the transfix roller 632 can be the same size or larger than the imaging drum 628.

Printer 600 includes a media transport, which removes media sheets from the media supplies 604 and 608 and delivers the media sheets through the nip 636 and to the output tray 644. The media supplies 604 and 608 can include different sizes and types of media sheets, some of which can include tabs or punched holes. In other embodiments the printer can include more than two media supplies to enable the printer to print on a wide variety of media types and sizes. The media transport includes a plurality of rollers 612, some of which are driven by actuators 614 operatively connected to a controller 660, and media guides that control the movement of media sheets in a process direction 616 and a cross-process direction as the media sheets approach and pass through the transfix nip 636. The media path further includes a duplex process direction 620 and an inverter 640. In a duplex print mode, the printer 600 transfixes an image to a first side of a media sheet, and the media sheet is then inverted by the media inverter 640 and guided in the duplex process direction 620 back to the transfix nip 636. The inverted media sheet passes through the transfix nip 636 a second time and the printer 600 transfixes a second image to the second side of the media sheet, which is then deposited in the media output tray 644.

Operation and control of the various subsystems, components and functions of the printer 600, including the media path actuators 614 and printheads 624A-624H, are performed with the aid of a controller or electronic subsystem (ESS) 660. The ESS or controller 660, for example, is a self-contained, dedicated computer having a central processor unit (CPU) with a memory, and a display or user interface (UI) 386. The CPU reads, captures, prepares and manages the image data flow associated with print jobs received from image input sources and controls the media transport actuators 614 to align and time the insertion of media sheets into the transfix nip 636 as described above. The CPU generates electric signals that operate ink ejectors in the printheads 624A-624H with reference to the timing of the insertion of the media sheets into the nip 636.

Figure 8:
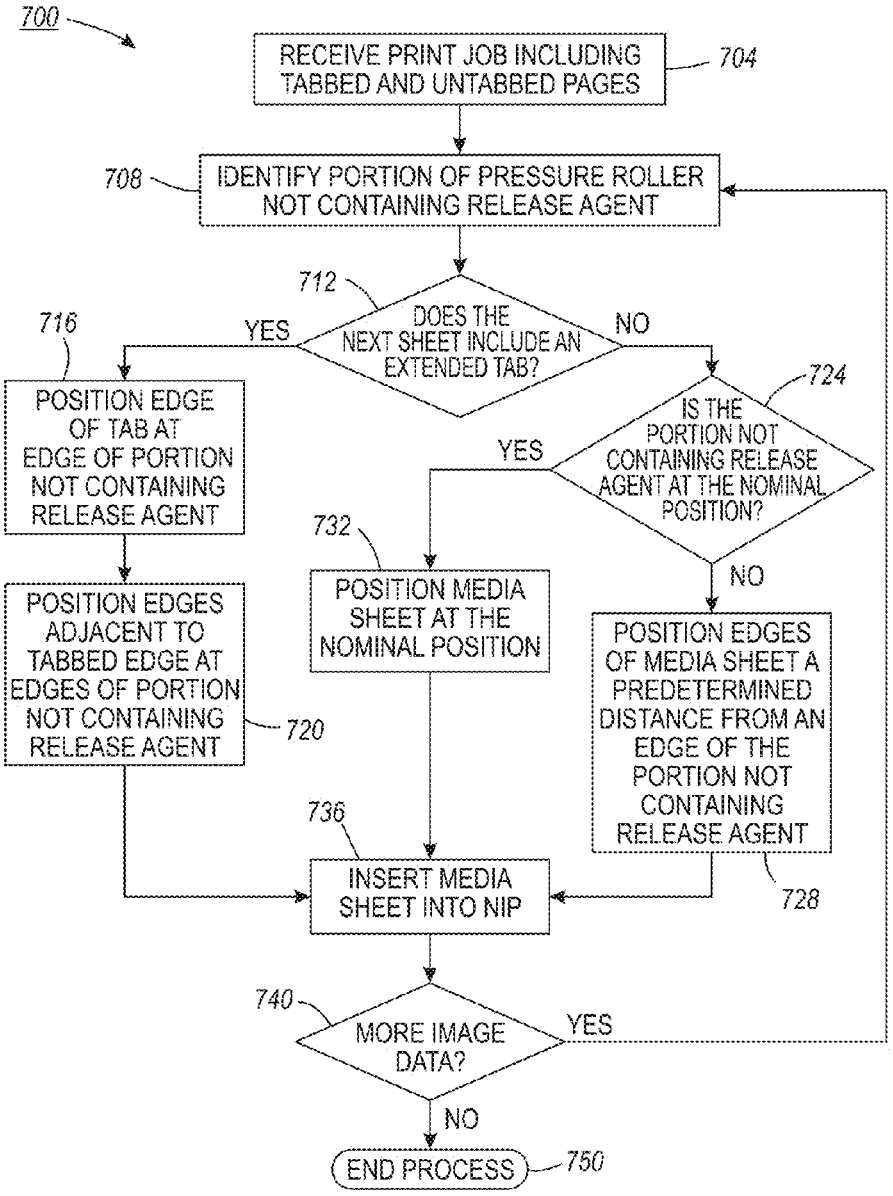
FIG. 8 is a block diagram of a process for operating a printer in a duplex printing mode.

FIG. 8 depicts a process 700 for printing to media sheets in a duplex mode while reducing transfer of release agent to an unprinted side of a tabbed media sheet. In this figure, the term pressure roller is used to describe a transfix roller or pressure roller like those described in FIG. 1, FIG. 2, FIG. 5, FIG. 6, and FIG. 7. In the discussion below, a reference to the process performing a function or action refers to a controller executing programmed instructions stored in a memory to operate one or more components to perform the function or action. Process 700 begins as the printer receives a print job to print images on tabbed and untabbed media sheets. The print job can be received from an optical scanner attached to the printer or from a computer or other electronic device through an interface.

Process 700 identifies a portion of the pressure roller bearing substantially less release agent (block 708). The rotational position of the pressure roller is determined with reference to signals from the rotational sensor as the pressure roller engages a second roller, for example, an imaging drum or transfix roller. Alternatively, the rotational position can be identified without a sensor from stored data corresponding to previous printed sheets, the speed of the rollers, and the diameters of the rollers. The controller determines the lateral position of the portion bearing substantially less release agent from a memory associated with the controller, which stores the lateral alignment and media type of the previous media sheet. Alternatively, the lateral position of the portion bearing substantially less release agent can be sensed with an optical sensor configured to sense release agent on the roller. In a roller including more than one pitch, such as the roller of FIG. 2, the identification of the portion bearing substantially less release agent refers to the portion on the pitch that enters the nip next as the roller rotates.

Process 700 continues as the controller determines if the next media sheet to be printed includes an extended tab (block 712). If the next media sheet to be printed includes an extended tab, the controller operates the media transport to position an edge of the tab at an edge of the portion bearing substantially less release agent to enable the tab to contact only the portion of the first roller bearing substantially less release agent (block 716). If the tab is at a leading or trailing edge of the media sheet, the media transport is operated to change the velocity of the media sheet to time the insertion of the edge of the tab to coincide with the leading or trailing edge, respectively, of the portion of the roller bearing substantially less release agent entering the nip. If the tab is on a lateral edge of the media sheet, then the media transport laterally shifts the edge of the tab to align the edge of the tab with an edge of the portion bearing substantially less release agent. The media transport then aligns the edges of the media sheet adjacent to the edge having the tab with edges of the portion of the roller bearing substantially less release agent (block 720) to minimize the transfer of release agent to the second side of the other portions of the media sheet. The leading edge of the media sheet is then inserted into the nip as the portion bearing substantially less release agent enters the nip (block 736). For a tabbed media sheet having a tab on the leading edge, the edge of the tab is inserted into the nip as the portion bearing substantially less release agent enters the nip. Tabbed media sheets having a tab on the trailing edge are inserted to enable the edge of the tab of the media sheet to contact the trailing edge of the portion bearing substantially less release agent. If the tab is on a lateral edge, the media transport alters the velocity of the media sheet to insert the leading edge of the media sheet into the nip at the same time as the portion bearing substantially less release agent enters the nip, to enable the tab and the majority of the media sheet to pass through the nip without collecting release agent.

If the next sheet to be printed does not include an extended tab (block 712), the controller determines if the portion bearing substantially less release agent is at the nominal position (block 724). As described above with reference to FIG. 3A-4C, the nominal position refers to the position on the roller of the portion bearing substantially less release agent prior to printing. If the portion of the surface of the first roller bearing substantially less release agent is at the nominal position, the controller instructs the media transport to position the media sheet at the nominal position (block 732) and to alter the velocity of the media sheet to insert the leading edge of the media sheet into the nip as the area bearing substantially less release agent enters the nip (block 736).

If the portion bearing substantially less release agent is not at the nominal position (block 724), then the controller operates the media transport to position an edge of the media sheet a predetermined distance from an edge of the portion of the surface of the roller bearing substantially less release agent (block 728). If the portion bearing substantially less release agent is shifted in the cross-process direction from the nominal position, then the media transport shifts the media sheet laterally from the portion bearing substantially less release agent by the predetermined distance in the direction of the nominal position. In one practical embodiment the predetermined distance is approximately two millimeters, although other distances can be used in alternative embodiments. If the portion of the roller bearing substantially less release agent is shifted in the process direction from the nominal position, then the media transport alters the velocity of the media sheet to enable the media sheet to contact the pressure roller in the nip the predetermined distance from the edge of the portion of the surface of the pressure roller bearing substantially less release agent, while aligning the lateral edges with the portion bearing substantially less release agent to enable the media sheet to pass through the nip collecting a minimal amount of release agent while shifting toward the nominal position. The controller then operates the media transport to insert the media sheet into the nip as the portion bearing substantially less release agent enters the nip (block 732).

The controller next determines if there is more image data in the print job ready for printing (block 736). If there is additional image data ready, then the process continues (block 708). If there is no more image data, then the process terminates (block 740).

It should be appreciated that while the process 700 is described with reference to tabbed media sheets, a similar process can apply to hole-punched media and to sheets of a different size than the media used for the bulk of the print job, for example, 9 inch by 11 inch covers mixed into a print job of primarily 8.5 inch by 11 inch sheets. The different sizes and types of media sheets are aligned to enable minimal transfer of release agent to areas of the second side of the media sheet being printed. Shifting media back to the nominal position can be accomplished in the same manner as described above in process 700.

It will be appreciated that variations of the above-disclosed and other features and functions, or alternatives thereof, may by desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A method of operating a printer comprising:

operating with a controller a media transport to move media sheets through a nip formed between a first roller and a second roller;

applying release agent with an applicator to the first roller only; and adjusting operation of the media transport with the controller to insert a leading edge of a media sheet into the nip as a first portion of the second roller on which release agent transferred from the first roller exits the nip in response to the controller determining that the media sheet being inserted into the nip is different than a previous media sheet that passed through the nip immediately prior to the media sheet being inserted into the nip to enable the media sheet to be interposed between the first roller and a second portion of the second roller bearing substantially less release agent than the first portion as the media sheet passes through the nip.

2. The method of claim 1 wherein the first roller is a rotating image drum and the second roller is a transfix roller.

3. The method of claim 2 further comprising:

forming an ink image on the rotating image drum after application of the release agent and while the nip remains formed between the rotating image drum and the transfix roller.

4. The method of claim 2 further comprising:

separating the rotating image drum from the transfix roller to enable an ink image to be formed on the rotating image drum during multiple rotations of the rotating image drum; and moving the transfix roller into engagement with the rotating image drum to form the nip after the ink image is formed.

5. The method of claim 1 wherein the first roller is a spreader roller and the second roller is a pressure roller.

6. The method of claim 1 further comprising:

selectively forming the nip between the first roller and the second roller.

7. The method of claim 1, the media transport operation adjustment further comprising:

adjusting the operation of the media transport with reference to the media sheet being a tabbed media sheet.

8. The method of claim 7, the media transport operation adjustment further comprising:

timing the insertion of the tabbed media sheet into the nip to enable the tab to contact only the second portion of the second roller.

9. The method of claim 8 further comprising:

adjusting the operation of the media transport to time the insertion of a next media sheet into the nip offset by a predetermined distance from an area of the second roller contacted by the tabbed media sheet toward an area of the second roller contacted by the previous media sheet.

10. The method of claim 9 further comprising:

adjusting the operation of the media transport to time the insertion into the nip of subsequent media sheets in a sequence of media sheets the predetermined distance from an area on the surface of the first roller that was contacted by a preceding media sheet in the sequence of media sheets until a media sheet in the sequence of media sheets enters the nip as the second portion on the surface of the second roller enters the nip.

11. The method of claim 1, the media transport operation adjustment further comprising:

adjusting the operation of the media transport with reference to the media sheet being a hole punched media sheet.

12. The method of claim 1, the media transport operation adjustment further comprising:

adjusting the operation of the media transport with the controller with reference to the controller determining the media sheet being inserted into the nip is a media sheet having different dimensions than a previous media sheet that passed through the nip immediately prior to the media sheet being inserted into the nip.

13. A printer comprising:

a media transport including a plurality of actuators, each actuator configured to drive a roller in the media transport to move media sheets through a nip formed between a first roller and a second roller;

a release agent applicator configured to apply release agent to the first roller only; and a controller operatively connected to the plurality of actuators of the media transport, the controller being configured to determine whether a next media sheet to be inserted into the nip is different than a media sheet that immediately preceded the next media sheet into the nip and to generate electrical signals to adjust operation of the media transport to insert a leading edge of a media sheet into the nip as a first portion of the second roller on which release agent transferred from the first roller exits the nip in response to the determination that the next media sheet is different than the immediately preceding media sheet that passed through the nip to enable the next media sheet to be interposed between the first roller and a second portion of the second roller bearing substantially less release agent than the first portion as the media sheet passes through the nip.

14. The printer of claim 13, the controller being further configured to adjust the operation of the media transport with reference to the media sheet being a tabbed media sheet.

15. The printer of claim 13, the controller being further configured to adjust the operation of the media transport with reference to the media sheet being a hole-punched media sheet.

16. The printer of claim 13, the controller being further configured to determine whether the next media sheet to be inserted into the nip has different dimensions than the media sheet that immediately preceded the next media sheet into the nip and to adjust the operation of the media transport with reference to the determination that the next media sheet has dimensions different than the media sheet that immediately preceded the next media sheet through the nip.

17. The printer of claim 13 wherein the first roller is a rotating image drum and the second roller is a transfix roller.

18. The printer of claim 17, the rotating image drum and the transfix roller being fixed to form the nip.

19. The printer of claim 17 further comprising:

an actuator operatively connected to the transfix roller and configured to move the transfix roller out of engagement with the rotating image drum to enable an ink image to be formed on the rotating image drum during multiple rotations of the rotating image drum and to move the transfix roller into engagement with the rotating image drum to form the nip after the ink image is formed.

20. The printer of claim 19 further comprising:

a sensor operatively connected to the controller and configured to generate an electronic signal that identifies a rotational position of the first and second portions of the transfix roller.

* * * * *